US012618222B2

(12) United States Patent
Wiewel et al.

(10) Patent No.: US 12,618,222 B2
(45) Date of Patent: May 5, 2026

(54) AUTO SWING CONTROL TO AN ALIGNMENT FOR SWING BOOM MACHINES

(71) Applicant: Caterpillar Trimble Control Technologies LLC, Dayton, OH (US)

(72) Inventors: Bruce J. Wiewel, East Peoria, IL (US); Joshua Callaway, Cary, NC (US); Christopher Corwin, Westminster, CO (US)

(73) Assignees: Caterpillar Trimble Control Technologies LLC, Dayton, OH (US); Caterpillar Inc., Peoria, IL (US)

( * ) Notice: Subject to any disclaimer, the term of this patent is extended or adjusted under 35 U.S.C. 154(b) by 293 days.

(21) Appl. No.: 18/215,710

(22) Filed: Jun. 28, 2023

(65) Prior Publication Data

US 2025/0003177 A1 Jan. 2, 2025

(51) Int. Cl.

| | |
|---|---|
| ***E02F 3/43*** | (2006.01) |
| ***E02F 9/26*** | (2006.01) |
| *E02F 9/20* | (2006.01) |

(52) U.S. Cl.

CPC ..... *E02F 3/437* (2013.01); *E02F 9/265* (2013.01); *E02F 9/20* (2013.01)

(58) Field of Classification Search

CPC ..... E02F 3/43; E02F 3/437; E02F 9/26; E02F 9/265; E02F 9/2025; E02F 9/2037; E02F 9/2012; E02F 9/2008; E02F 9/121; E02F 9/123; E02F 9/14

USPC ..... 701/50

See application file for complete search history.

(56) References Cited

U.S. PATENT DOCUMENTS

| | | | | |
|---|---|---|---|---|
| 10,640,948 | B2 | 5/2020 | Ishiai et al. | |
| 11,821,161 | B2 * | 11/2023 | Tsukamoto | E02F 9/261 |
| 11,828,039 | B2 * | 11/2023 | Tsukamoto | E02F 9/2282 |
| 12,134,348 | B2 * | 11/2024 | Vazquez | E02F 3/434 |

(Continued)

FOREIGN PATENT DOCUMENTS

| | | | |
|---|---|---|---|
| CN | 110945187 | A | 3/2020 |
| WO | 2022/210619 | A1 | 10/2022 |

OTHER PUBLICATIONS

Yao, Jie, et al. "Bucket loading trajectory optimization for the automated wheel loader." IEEE transactions on vehicular technology 72.6 6948-6958 (Year: 2023). (Year: 2023).*

(Continued)

*Primary Examiner* — Cuong H Nguyen

(74) *Attorney, Agent, or Firm* — Kilpatrick Townsend & Stockton LLP

(57) ABSTRACT

Described herein are systems, methods, and other techniques for performing an alignment operation concurrently with a retraction operation at a construction machine. A guidance line is set for guiding an implement of the construction machine. An input signal is received via a user input device for moving the construction machine to reduce an extension distance between the implement and the machine's platform. A first control signal is generated to cause a movement of the construction machine to reduce the extension distance. During the movement of the construction machine, a second control signal is generated to cause the machine's boom to horizontally rotate with respect to the platform such that the implement moves along and remains aligned with the guidance line.

20 Claims, 9 Drawing Sheets

(56) References Cited

U.S. PATENT DOCUMENTS

| | | | | |
|---|---|---|---|---|
| 12,163,310 | B2 * | 12/2024 | Sano | E02F 9/2292 |
| 2018/0313062 | A1 * | 11/2018 | Tsukamoto | E02F 9/20 |
| 2022/0002970 | A1 * | 1/2022 | Kurosawa | E02F 3/437 |
| 2022/0332248 | A1 * | 10/2022 | Vazquez | B60R 1/00 |
| 2023/0078047 | A1 * | 3/2023 | Nishi | E02F 9/264 701/50 |
| 2024/0011241 | A1 * | 1/2024 | Sano | E02F 9/2012 |

OTHER PUBLICATIONS

Sun, Haoran, et al. "Bucket structure optimization of backhoe hydraulic excavator based on compound digging trajectory and limit digging force." Advances in Mechanical Engineering 14.4 16878132221092988 (Year: 2022). (Year: 2022).*

Molaei, Amirmasoud, Marcus Geimer, and Antti Kolu. "Evaluation of deterministic models for the excavator." EC3 Conference 2023. vol. 4. European Council on Computing in Construction (Year: 2023). (Year: 2023).*

Wang, Yong, et al. "Optimization of excavator bucket structure by a coupled simulation method." Applied Sciences 13.20 ; 11336 (Year: 2023). (Year: 2023).*

Wang, Yong, Linlin Wang, Chenchen Li, Ziao Xue, Yuan Sun, Ruiyong Ma, Dagang Wang et al. "Optimization of excavator bucket structure by a coupled simulation method." Applied Sciences 13, No. 20 (2023): 11336. (Year: 2023) (Year: 2023).*

International Search Report and Written Opinion for Application No. PCT/US2024/035286, mailed Oct. 17, 2024, 9 pages.

* cited by examiner

AUTO SWING CONTROL TO AN ALIGNMENT FOR SWING BOOM MACHINES

BACKGROUND OF THE INVENTION

Modern mobile machinery, including construction and agricultural machines, have dramatically increased the efficiency of performing various work-related tasks. For example, earthmoving machines employing automatic grade control systems are able to grade project areas using fewer passes than what was previously done manually. As another example, modern asphalt pavers and other road makers have allowed replacement of old roads and construction of new roads to occur on the order of hours and days instead of what once took place over weeks and months. Due to the automation of various aspects, construction and agriculture projects can be carried out by crews with fewer individuals than what was previously required. The technological breakthroughs in mobile machinery owe much to the availability of accurate sensors that allow real-time monitoring of the condition and position of a machine's components and/or the surrounding environment.

Despite the improvements to modern mobile machinery, new systems, methods, and techniques are still needed.

SUMMARY OF THE INVENTION

A summary of the various embodiments of the invention is provided below as a list of examples. As used below, any reference to a series of examples is to be understood as a reference to each of those examples disjunctively (e.g., "Examples 1-4" is to be understood as "Examples 1, 2, 3, or 4").

Example 1 is a computer-implemented method comprising: setting a guidance line for guiding an implement of a construction machine, the guidance line having a path relative to a position of the construction machine, the construction machine having a boom, a platform, and an undercarriage, wherein the boom is semi-rigidly connected to the platform at a boom swing joint, the boom being horizontally rotatable with respect to the platform, and wherein the platform is semi-rigidly connected to the undercarriage; receiving, via a user input device, an input signal for moving the construction machine to reduce an extension distance between the implement and the platform; generating a first control signal to cause a movement of the construction machine to reduce the extension distance; and during the movement of the construction machine, generating a second control signal to cause the boom to horizontally rotate with respect to the platform such that the implement moves along and remains aligned with the guidance line.

Example 2 is the method of example(s) 1, wherein the second control signal causes a boom swing cylinder to extend or retract to cause the boom to horizontally rotate.

Example 3 is the method of example(s) 1-2, further comprising: computing a horizontal boom angle to which to horizontally rotate the boom based at least on the extension distance, wherein the second control signal causes the boom to horizontally rotate with respect to the platform to the horizontal boom angle.

Example 4 is the method of example(s) 3, wherein the horizontal boom angle is determined further based on an offset angle between an orientation of the construction machine and the guidance line.

Example 5 is the method of example(s) 1-4, further comprising: during the movement of the construction machine, generating a third control signal to cause the platform to horizontally rotate with respect to the undercarriage such that the implement moves along and remains aligned with the guidance line.

Example 6 is the method of example(s) 5, further comprising: computing a horizontal platform angle to which to horizontally rotate the platform based at least on the extension distance, wherein the third control signal causes the platform to horizontally rotate with respect to the undercarriage to the horizontal platform angle.

Example 7 is the method of example(s) 6, wherein the horizontal platform angle is determined further based on an offset angle between an orientation of the construction machine and the guidance line.

Example 8 is the method of example(s) 1-7, wherein the construction machine is an excavator, and wherein the implement is a bucket.

Example 9 is a non-transitory computer-readable medium comprising instructions that, when executed by one or more processors, cause the one or more processors to perform operations comprising: setting a guidance line for guiding an implement of a construction machine, the guidance line having a path relative to a position of the construction machine, the construction machine having a boom, a platform, and an undercarriage, wherein the boom is semi-rigidly connected to the platform at a boom swing joint, the boom being horizontally rotatable with respect to the platform, and wherein the platform is semi-rigidly connected to the undercarriage; receiving, via a user input device, an input signal for moving the construction machine to reduce an extension distance between the implement and the platform; generating a first control signal to cause a movement of the construction machine to reduce the extension distance; and during the movement of the construction machine, generating a second control signal to cause the boom to horizontally rotate with respect to the platform such that the implement moves along and remains aligned with the guidance line.

Example 10 is the non-transitory computer-readable medium of example(s) 9, wherein the second control signal causes a boom swing cylinder to extend or retract to cause the boom to horizontally rotate.

Example 11 is the non-transitory computer-readable medium of example(s) 9-10, wherein the operations further comprise: computing a horizontal boom angle to which to horizontally rotate the boom based at least on the extension distance, wherein the second control signal causes the boom to horizontally rotate with respect to the platform to the horizontal boom angle.

Example 12 is the non-transitory computer-readable medium of example(s) 11, wherein the horizontal boom angle is determined further based on an offset angle between an orientation of the construction machine and the guidance line.

Example 13 is the non-transitory computer-readable medium of example(s) 9-12, wherein the operations further comprise: during the movement of the construction machine, generating a third control signal to cause the platform to horizontally rotate with respect to the undercarriage such that the implement moves along and remains aligned with the guidance line.

Example 14 is the non-transitory computer-readable medium of example(s) 13, wherein the operations further comprise: computing a horizontal platform angle to which to horizontally rotate the platform based at least on the extension distance, wherein the third control signal causes the platform to horizontally rotate with respect to the undercarriage to the horizontal platform angle.

Example 15 is the non-transitory computer-readable medium of example(s) 14, wherein the horizontal platform angle is determined further based on an offset angle between an orientation of the construction machine and the guidance line.

Example 16 is the non-transitory computer-readable medium of example(s) 9-15, wherein the construction machine is an excavator, and wherein the implement is a bucket.

Example 17 is a machine control system for controlling a construction machine, the machine control system comprising: one or more processors; and a computer-readable medium comprising instructions that, when executed by the one or more processors, cause the one or more processors to perform operations comprising: setting a guidance line for guiding an implement of a construction machine, the guidance line having a path relative to a position of the construction machine, the construction machine having a boom, a platform, and an undercarriage, wherein the boom is semi-rigidly connected to the platform at a boom swing joint, the boom being horizontally rotatable with respect to the platform, and wherein the platform is semi-rigidly connected to the undercarriage; receiving, via a user input device, an input signal for moving the construction machine to reduce an extension distance between the implement and the platform; generating a first control signal to cause a movement of the construction machine to reduce the extension distance; and during the movement of the construction machine, generating a second control signal to cause the boom to horizontally rotate with respect to the platform such that the implement moves along and remains aligned with the guidance line.

Example 18 is the machine control system of example(s) 17, wherein the second control signal causes a boom swing cylinder to extend or retract to cause the boom to horizontally rotate.

Example 19 is the machine control system of example(s) 17-18, wherein the operations further comprise: computing a horizontal boom angle to which to horizontally rotate the boom based at least on the extension distance, wherein the second control signal causes the boom to horizontally rotate with respect to the platform to the horizontal boom angle.

Example 20 is the machine control system of example(s) 19, wherein the horizontal boom angle is determined further based on an offset angle between an orientation of the construction machine and the guidance line.

Example 21 is the machine control system of example(s) 17-20, wherein the operations further comprise: during the movement of the construction machine, generating a third control signal to cause the platform to horizontally rotate with respect to the undercarriage such that the implement moves along and remains aligned with the guidance line.

Example 22 is the machine control system of example(s) 21, wherein the operations further comprise: computing a horizontal platform angle to which to horizontally rotate the platform based at least on the extension distance, wherein the third control signal causes the platform to horizontally rotate with respect to the undercarriage to the horizontal platform angle.

Example 23 is the machine control system of example(s) 22, wherein the horizontal platform angle is determined further based on an offset angle between an orientation of the construction machine and the guidance line.

Example 24 is the machine control system of example(s) 17-23, wherein the construction machine is an excavator, and wherein the implement is a bucket.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and various ways in which it may be practiced.

DETAILED DESCRIPTION OF THE INVENTION

The present invention relates to a novel technique for controlling an excavator, specifically designed to enhance the precision and efficiency of the equipment's operation. The described technique involves automatically horizontally rotating the boom and/or the platform of the excavator to align a guidance point on the excavator with a predefined guidance line while the operator is curling and moving the bucket to bring it closer to the platform. The technique thus includes automatically performing an alignment operation while the operator manually performs a retraction operation. This alignment enables the excavator to perform excavation tasks with improved accuracy and reduced need for manual intervention or repositioning of the equipment. The present invention not only streamlines the excavation process but also increases the overall safety and productivity of construction sites by minimizing the risk of human error and facilitating precise and consistent movements of the excavator's boom.

In the following description, various examples will be described. For purposes of explanation, specific configurations and details are set forth in order to provide a thorough understanding of the examples. However, it will also be apparent to one skilled in the art that the example may be practiced without the specific details. Furthermore, well-known features may be omitted or simplified in order not to obscure the embodiments being described.

The figures herein follow a numbering convention in which the first digit or digits correspond to the figure number and the remaining digits identify an element or component in the figure. Similar elements or components between different figures may be identified by the use of similar digits. For example, 108 may reference element "08" in FIG. 1, and a similar element may be referenced as 208 in FIG. 2. As will be appreciated, elements shown in the various embodiments herein can be added, exchanged, and eliminated so as to provide a number of additional embodiments of the present disclosure. In addition, the proportion and the relative scale of the elements provided in the figures are intended to illustrate certain embodiments of the present disclosure and should not be taken in a limiting sense.

Figure 1B:
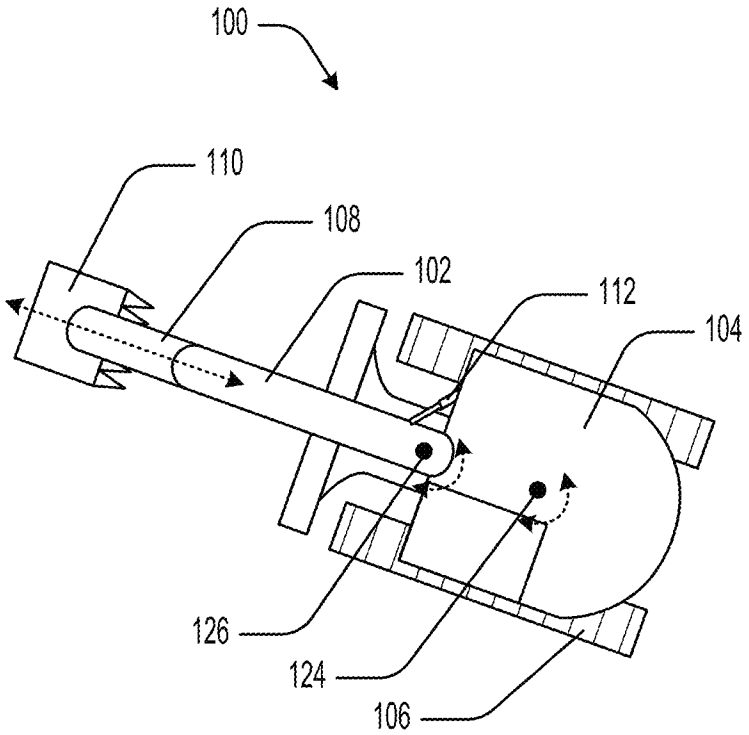
FIGS. 1A and 1B illustrate an example construction machine from a perspective view and a top view.
Figure 1A:
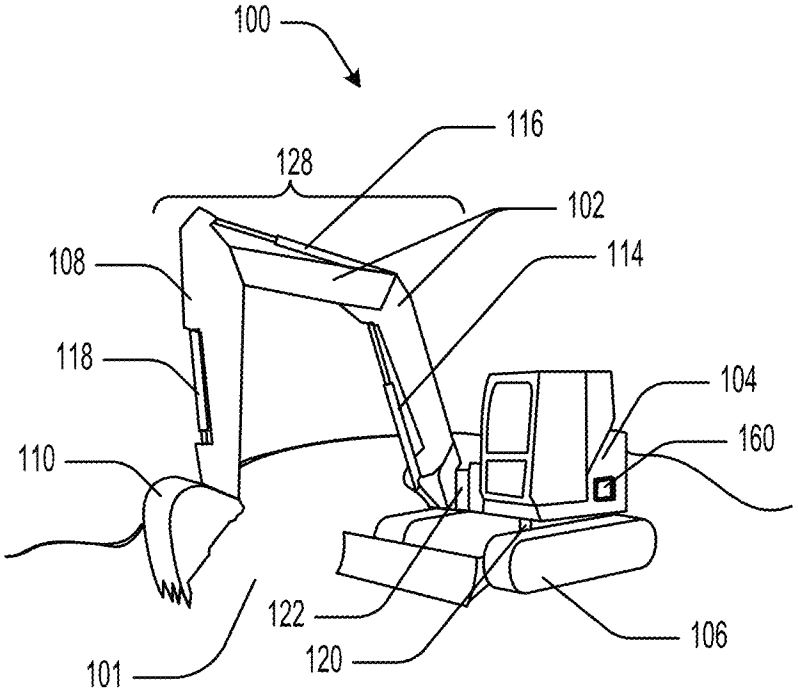

FIGS. 1A and 1B illustrate an example construction machine 100 from a perspective view and a top view, respectively, in accordance with some embodiments of the present disclosure. Specifically, FIG. 1A shows construction machine 100 being deployed at a construction site 101 and having the control thereof at least partially implemented by a control unit 160. While construction site 101 is generally described herein as corresponding to an earthmoving site such as a road or building construction site, the present disclosure is applicable to a wide variety of construction, maintenance, or agricultural projects in which heavy equipment or mobile machinery are used. Similarly, while construction machine 100 is generally described herein as corresponding to an earthmoving construction machine such as an excavator, the various techniques described herein may be applicable to a wide variety of construction machines or heavy equipment such as graders, bulldozers, backhoes, trenchers, pavers (e.g., concrete, asphalt, slipform, vibratory, etc.), compactors, scrapers, loaders, material handlers, forklifts, combine harvesters, spreaders, and the like.

Construction machine 100 may have various embodiments, such as a tractor with wheels, axles, and a gasoline-, diesel-, electric-, or steam-powered engine that provides power and traction to drive along a desired path, typically at a constant speed. Construction machine 100 may be a tracked vehicle that uses a continuous track of treads or track plates driven by the vehicle's wheels. An operator can control construction machine 100 by providing inputs to control unit 160 using a range of input devices, including levers, switches, buttons, pedals, steering wheels, and touch screens. These inputs can cause various actuators to move construction machine 100.

In some instances, construction machine 100 includes an implement 110, which may be the primary component of construction machine 100 that interacts with elements of construction site 101. For example, at an earthmoving site, implement 110 may be the blade of a bulldozer, the bucket of an excavator, or the drum of a compactor that interacts with (e.g., pushes, scoops, cuts, etc.) the earth. As another example, at an agricultural site, implement 110 may be the header of a combine harvester or the boom of a spreader. As another example, at a road construction site, implement 110 may be the screed of an asphalt paver.

In some examples, construction machine 100 may include an undercarriage 106 supporting the entire machine structure. Undercarriage 106 is designed to provide stability, mobility, and ground clearance, thereby facilitating movement of construction machine 100 on various terrains and conditions. A platform 104 is positioned above undercarriage 106 and is horizontally rotatable with respect to the undercarriage 106 via a platform joint 120. Platform 104 serves as a base for mounting various components of construction machine 100, including a cab which houses an operator of construction 100 as well as an arm 128 that connects implement 110 to platform 104, where arm 128 includes a boom 102 and a stick 108. The platform's ability to rotate horizontally about an axis of rotation 124 enables construction machine 100 to maneuver easily in tight spaces and improves its operational efficiency.

Boom 102 is vertically rotatable with respect to platform 104 and is also horizontally rotatable with respect to platform 104 via a boom swing joint 122. This dual-axis rotation allows boom 102 to cover a wide range of motion and provides construction machine 100 with increased flexibility during operation. Stick 108 is pivotally connected to boom 102. Stick 108, in combination with boom 102, enables construction machine 100 to achieve a greater reach and depth during digging and material handling operations. Implement 110 is pivotally connected to stick 108 and is designed to scoop, dig, and transport materials during excavation and construction processes.

Construction machine 100 further includes several cylinders that facilitate the movement of the boom 102, stick 108, and implement 110. A boom swing cylinder 112 causes boom 102 to rotate horizontally with respect to platform 104 about an axis of rotation 126. A boom cylinder 114 causes boom 102 to rotate vertically with respect to platform 104. A stick cylinder 116 causes stick 108 to rotate with respect to boom 102, and an implement cylinder 118 causes implement 110 to rotate with respect to stick 108. Each of these cylinders may be hydraulic cylinders that convert the hydraulic fluid's pressure into mechanical force.

In some embodiments, boom 102 and platform 104 may be considered as separate bodies that have a semi-rigid coupling between them. This coupling is semi-rigid in that the bodies can move relative to each other but can also be fixed at a given orientation. Boom 102 and platform 104 may therefore be considered to be semi-rigidly connected. Similarly, undercarriage 106 and platform 104 may be semi-rigidly connected.

In some embodiments, control unit 160 may determine the geospatial position of construction machine 100 based on sensor data captured by one or more sensors mounted to construction machine 100. For example, a position sensor (not shown in FIGS. 1A and 1B) may be mounted to construction machine 100 and may include a global navigation satellite system (GNSS) receiver that receives wireless signals from one or more GNSS satellites. By processing the received wireless signals, a geospatial position of the GNSS receiver may be calculated. The calculated geospatial may assist control unit 160 in determining geospatial positions of the various components of construction machine 100.

Figure 2A:
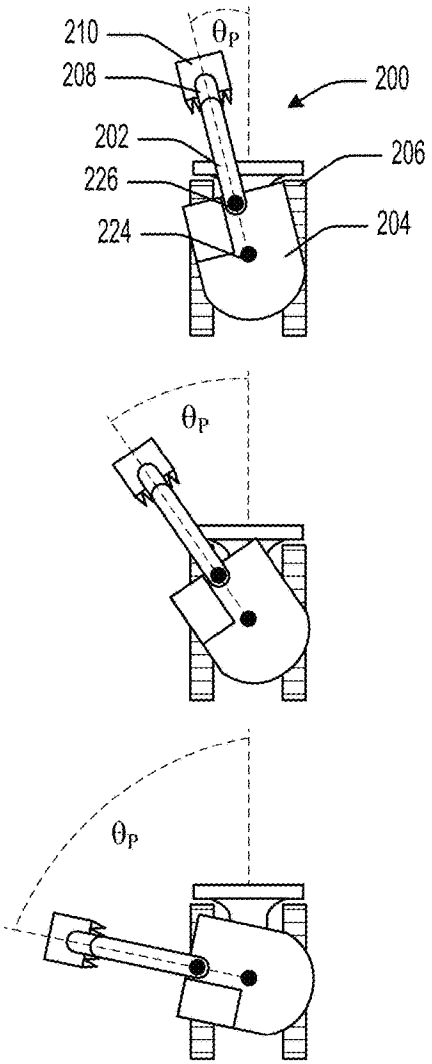
FIGS. 2A, 2B, and 2C illustrate example rotational movements of a construction machine.
Figure 2B:
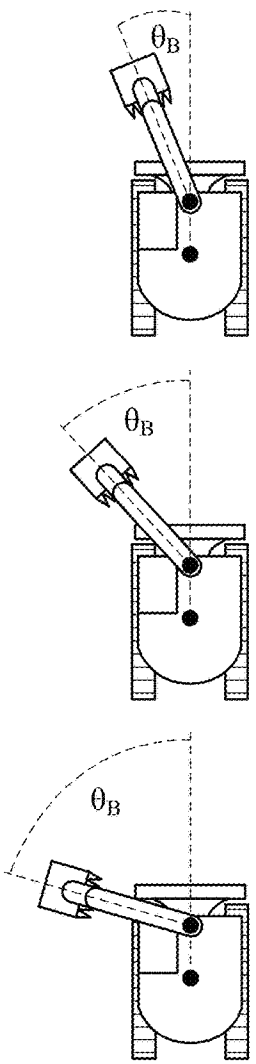
Figure 2C:
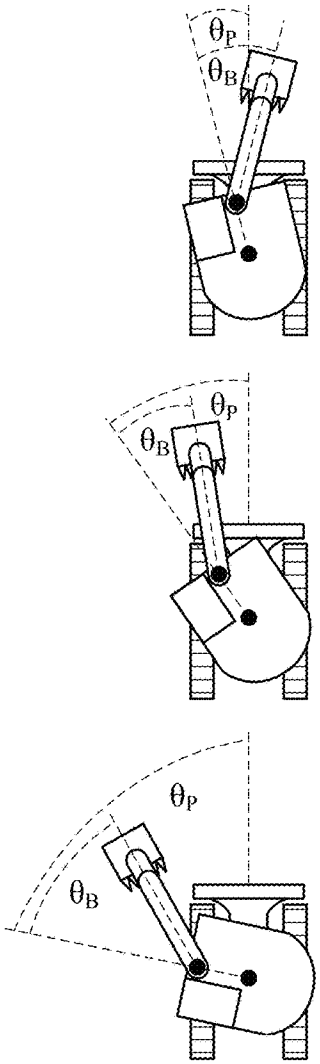

FIGS. 2A, 2B, and 2C illustrate example rotational movements of a construction machine 200, in accordance with some embodiments of the present disclosure. In FIG. 2A, construction machine 200 is controlled to horizontally rotate (in a yaw motion) platform 204 with respect to undercarriage 206 about axis 224 to achieve various horizontal platform angles $\theta_P$ formed between a first vector corresponding to the orientation of construction machine 200 (or undercarriage 206) and a second vector corresponding to the orientation of platform 204. In some instances, construction machine 100 may be designed such that horizontal platform angle $\theta_P$ can be varied between −180 and 180 degrees, allowing boom 202, stick 208, and implement 210 to achieve a wide range of positions.

In FIG. 2B, construction machine 200 is controlled to horizontally rotate (in a yaw motion) boom 202 with respect to platform 204 about axis of rotation 226 to achieve various horizontal boom angles $\theta_B$ formed between a first vector corresponding to the orientation of platform 204 and a second vector corresponding to the orientation of boom 202. In some instances, construction machine 100 may be designed such that horizontal boom angle $\theta_B$ can be varied between −90 and 90 degrees, whereas in other embodiments horizontal boom angle $\theta_B$ can be varied in a wider range of motion, such as between −135 and 135 degrees or between −180 and 180 degrees.

In FIG. 2C, both horizontal motions are simultaneously performed, i.e., construction machine 200 is controlled to horizontally rotate boom 202 with respect to platform 204 about axis of rotation 226 to achieve horizontal boom angles $\theta_B$ and is further controlled to horizontally rotate platform 204 with respect to undercarriage 206 about axis 224 to achieve various horizontal platform angles $\theta_P$. As shown in FIG. 2C, simultaneous control of horizontal boom angle $\theta_B$ and horizontal platform angle $\theta_P$ allows boom 202, stick 208, and implement 210 to achieve an even wider range of positions compared to FIGS. 2A and 2B.

Figure 3:
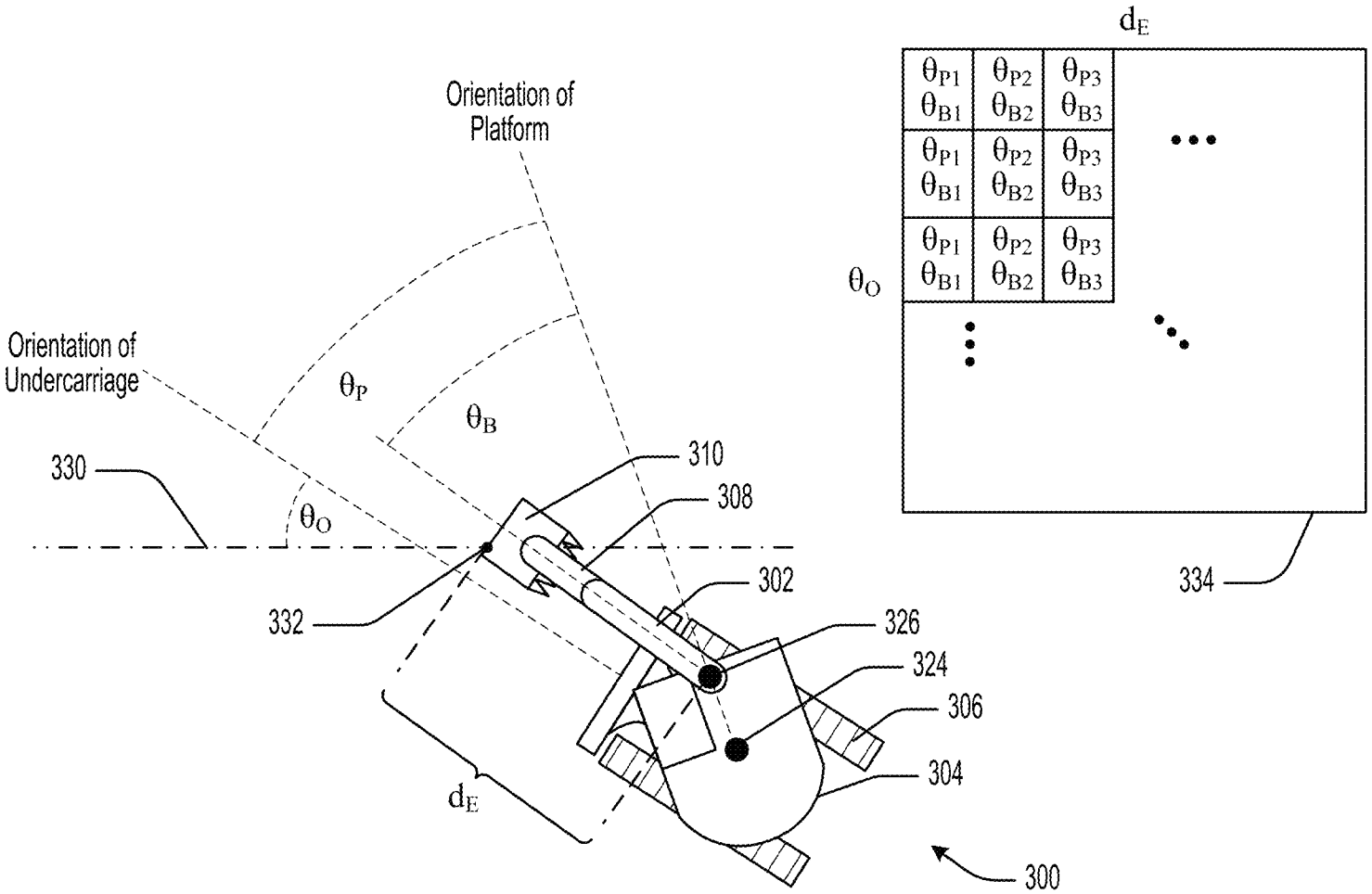
FIG. 3 illustrates example rotational movements of a construction machine based on computed rotation angles.

FIG. 3 illustrates example rotational movements of a construction machine 300 based on computed rotation angles, in accordance with some embodiments of the present disclosure. In the illustrated example, construction machine 300 includes an undercarriage 306, a platform 304, a boom 302, a stick 308, and an implement 310 (e.g., a bucket). While operating within a construction site, construction machine 300 may set a guidance line 330 along which earth is to be removed. Guidance line 330 may be set relative to the position and orientation of construction machine 300.

In some examples, an operator of construction machine 300 may move boom 302, stick 308, and implement 310 so that a guidance point 332 on implement 310 is aligned with guidance line 330. In some examples, the operator may do so while the horizontal boom angle $\theta_B$ about an axis of rotation 326 and/or the horizontal platform angle $\theta_P$ about an axis of rotation 324 are approximately equal to zero. Next, the operator may operate a user input device mounted to construction machine 300 to perform a retraction operation, causing an extension distance $d_E$ between guidance point 332 and axis of rotation 326 to decrease. This may include raising boom 302, lowering stick 308, and/or lowering implement 310. By operating the user input device, an input signal is sent to the control unit, which generates control signals that are sent to the corresponding actuators (e.g., boom cylinder, stick cylinder, and/or implement cylinder).

While the retraction operation is being performed, the control unit may automatically monitor the change in extension distance $d_E$ to compute the needed horizontal boom angle $\theta_B$ and/or horizontal platform angle $\theta_P$ that allow guidance point 332 to continue to be aligned with guidance line 330, thereby allowing an alignment operation to be performed concurrently with performing the retraction operation. After computing one or both of angles $\theta_B$ and $\theta_P$, the control unit may generate control signals that are sent to the corresponding actuators (e.g., boom swing cylinder, platform rotation actuator) to cause horizontal rotations of boom 302 about axis of rotation 326 and platform 304 about axis of rotation 324 to achieve the computed angle(s). Steps of computing angle(s) and generating control signal(s) may be repeated each time a new extension distance $d_E$ is detected.

Angles $\theta_B$ and $\theta_P$ may be computed based on the extension distance $d_E$ and an offset angle $\theta_O$ using trigonometric functions. The offset angle $\theta_O$ may be the angle formed between guidance line 330 and the orientation of undercarriage 306 (alternatively referred to as the orientation of construction machine 300). The computation of angles $\theta_B$ and $\theta_P$ may further take into account the physical dimensions of construction machine 300. For example, the distance between axis of rotations 324 and guidance point 332 and/or the distance between axis of rotations 324 and 326 can affect the computation. In some examples, a two-dimensional (2D) lookup table (LUT) 334 may be employed to compute one or both of angles $\theta_B$ and $\theta_P$. In some examples, LUT 334 may be indexed by extension distance $d_E$ and offset angle $\theta_O$ such that, for a given pair of extension distance $d_E$ and offset angle $\theta_O$, a pair of angles $\theta_B$ and $\theta_P$ may be obtained. In some embodiments in which undercarriage 306 remains stationary and therefore offset angle $\theta_O$ is constant, a row from LUT 334 may be retrieved at the beginning of the retraction operation corresponding to the offset angle $\theta_O$ to form a one-dimensional (1D) LUT that can be repeatedly accessed using the changing extension distance $d_E$. In some examples, LUT 334 may further indicate which angles correspond to clockwise rotations or counter-clockwise rotations.

Figure 4:
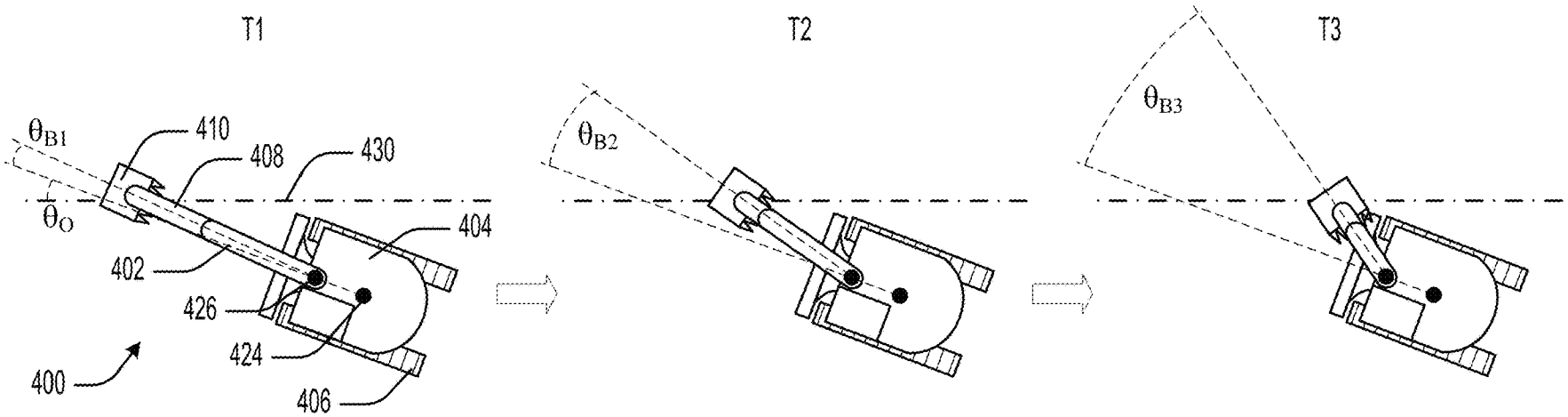
FIG. 4 illustrates an example of a construction machine performing an alignment operation concurrently with a retraction operation by horizontally rotating the boom.

FIG. 4 illustrates an example of a construction machine 400 performing an alignment operation concurrently with a retraction operation by horizontally rotating the boom, in accordance with some embodiments of the present disclosure. The retraction operation refers to the process of pulling the machine's arm (boom 402 and stick 408) back toward the machine after extending it outward to dig or move materials. This action is typically performed using hydraulic cylinders that control the movement of boom 402 and stick 408, allowing the operator to retract the arm and bring implement 410 closer to construction machine 400. In the example of FIG. 4, the alignment operation includes automatically horizontally rotating boom 402 with respect to platform 404 about axis of rotation 426 such that implement 410 remains aligned with a guidance line 430 during the entire retraction operation, without horizontally rotating platform 404 with respect to undercarriage 406 about axis of rotation 424.

At time T1, the control unit of construction machine 400 detects a first decrease in the extension distance and computes a first horizontal boom angle $\theta_{B1}$ to which boom 402 is to be horizontally rotated based on the offset angle $\theta_O$ and the extension distance. The control unit then generates control signals to cause boom 402 to horizontally rotate to the first horizontal boom angle $\theta_{B1}$. Similarly, at time T2, the control unit detects a second decrease in the extension distance and computes a second horizontal boom angle $\theta_{B2}$ to which boom 402 is to be horizontally rotated based on the offset angle $\theta_O$ and the extension distance. The control unit then generates control signals to cause boom 402 to horizontally rotate to the second horizontal boom angle $\theta_{B2}$. Similarly, at time T3, the control unit detects a third decrease in the extension distance and computes a third horizontal boom angle $\theta_{B3}$ to which boom 402 is to be horizontally rotated based on the offset angle $\theta_O$ and the extension distance. The control unit then generates control signals to cause boom 402 to horizontally rotate to the third horizontal boom angle $\theta_{B3}$.

Figure 5:
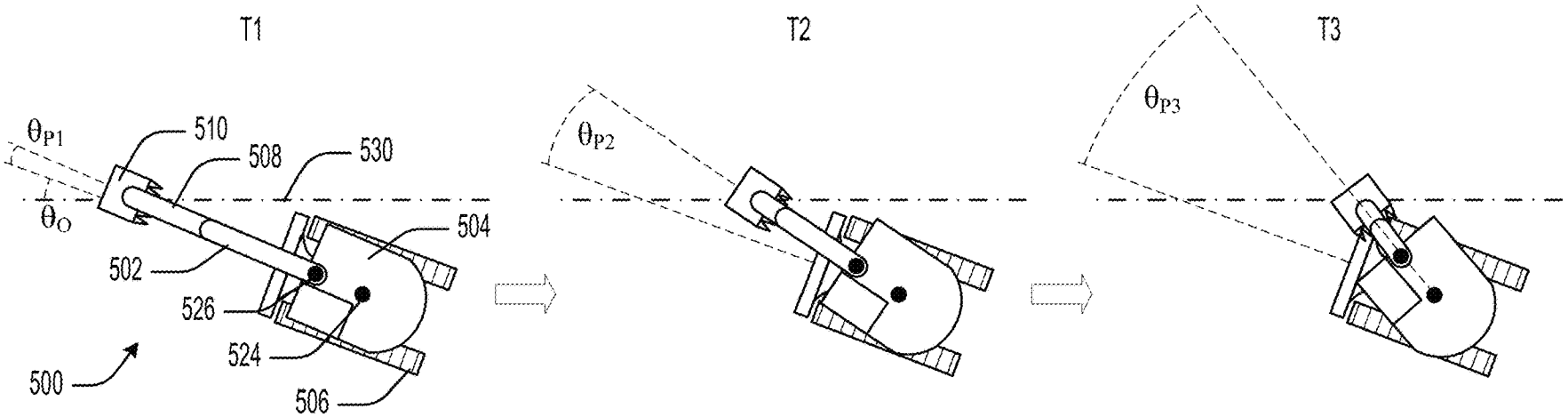
FIG. 5 illustrates an example of a construction machine performing an alignment operation concurrently with a retraction operation by horizontally rotating the platform.

FIG. 5 illustrates an example of a construction machine 500 performing an alignment operation concurrently with a retraction operation by horizontally rotating the platform, in accordance with some embodiments of the present disclosure. Similar to FIG. 4, the retraction operation refers to the process of pulling the machine's arm (boom 502 and stick 508) back toward the machine after extending it outward to dig or move materials. This action is typically performed using hydraulic cylinders that control the movement of boom 502 and stick 508, allowing the operator to retract the arm and bring implement 510 closer to construction machine 500. In the example of FIG. 5, the alignment operation includes automatically horizontally rotating platform 504 with respect to undercarriage 506 about axis of rotation 524 such that implement 510 remains aligned with a guidance line 530 during the entire retraction operation, without horizontally rotating boom 502 with respect to platform 504 about axis of rotation 526.

At time T1, the control unit of construction machine 500 detects a first decrease in the extension distance and computes a first horizontal platform angle $\theta_{P1}$ to which platform 504 is to be horizontally rotated based on the offset angle $\theta_O$ and the extension distance. The control unit then generates control signals to cause platform 504 to horizontally rotate to the first horizontal platform angle $\theta_{P1}$. Similarly, at time T2, the control unit detects a second decrease in the extension distance and computes a second horizontal platform angle $\theta_{P2}$ to which platform 504 is to be horizontally rotated based on the offset angle $\theta_O$ and the extension distance. The control unit then generates control signals to cause platform 504 to horizontally rotate to the second horizontal platform angle $\theta_{P2}$. Similarly, at time T3, the control unit detects a third decrease in the extension distance and computes a third horizontal platform angle $\theta_{P3}$ to which platform 504 is to be horizontally rotated based on the offset angle $\theta_O$ and the extension distance. The control unit then generates control signals to cause platform 504 to horizontally rotate to the third horizontal platform angle $\theta_{P3}$.

Figure 6:
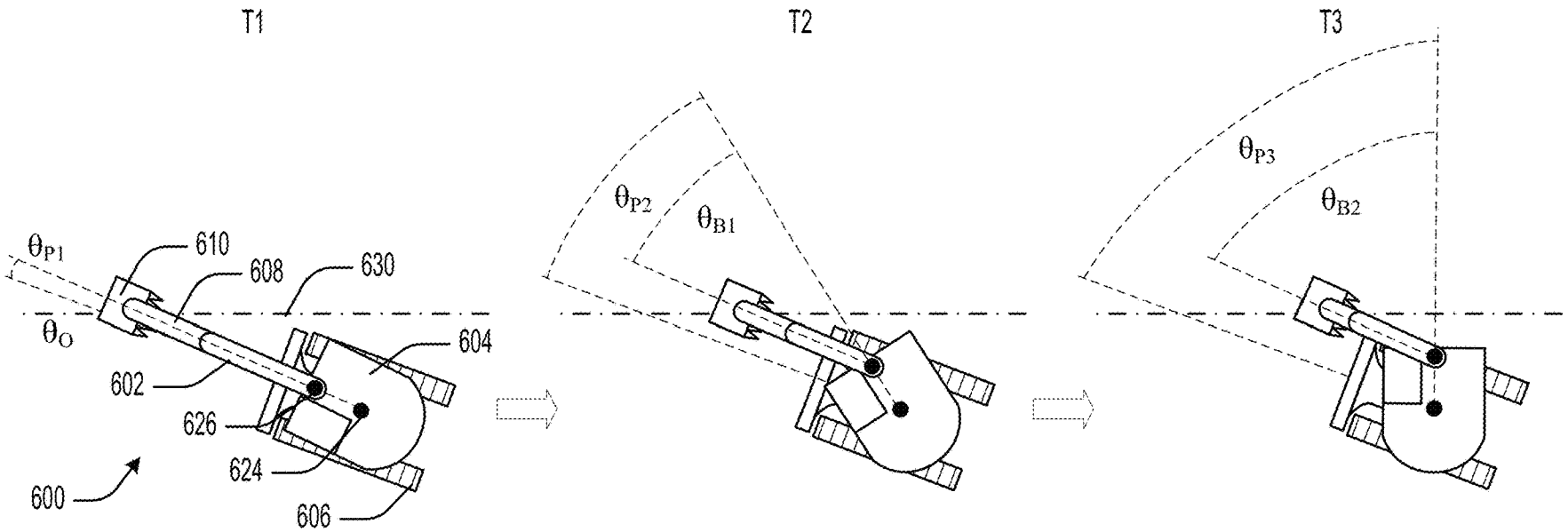
FIG. 6 illustrates an example of a construction machine performing an alignment operation concurrently with a retraction operation by horizontally rotating both the boom and the platform.

FIG. 6 illustrates an example of a construction machine 600 performing an alignment operation concurrently with a retraction operation by horizontally rotating both the boom and the platform, in accordance with some embodiments of the present disclosure. Similar to FIGS. 4 and 5, the retraction operation refers to the process of pulling the machine's arm (boom 602 and stick 608) back toward the machine after extending it outward to dig or move materials. This action is typically performed using hydraulic cylinders that control the movement of boom 602 and stick 608, allowing the operator to retract the arm and bring implement 610 closer to construction machine 600. In the example of FIG. 6, the alignment operation includes automatically horizontally rotating boom 602 with respect to platform 604 about axis of rotation 626 and horizontally rotating platform 604 with respect to undercarriage 606 about axis of rotation 624 such that implement 610 remains aligned with a guidance line 630 during the entire retraction operation.

At time T1, the control unit of construction machine 600 detects a first decrease in the extension distance and computes a first horizontal platform angle $\theta_{P1}$ to which platform 604 is to be horizontally rotated based on the offset angle $\theta_O$ and the extension distance. The control unit then generates control signals to cause platform 604 to horizontally rotate to the first horizontal platform angle $\theta_{P1}$. At time T2, the control unit detects a second decrease in the extension distance and computes a first horizontal boom angle $\theta_{B1}$ to which boom 602 is to be horizontally rotated (in a clockwise direction) and a second horizontal platform angle $\theta_{P2}$ to which platform 604 is to be horizontally rotated (in a counterclockwise direction) based on the offset angle $\theta_O$ and the extension distance. The control unit then generates control signals to cause boom 602 to horizontally rotate to the first horizontal boom angle $\theta_{B1}$ and platform 604 to horizontally rotate to the second horizontal platform angle $\theta_{P2}$.

Similarly, at time T3, the control unit detects a third decrease in the extension distance and computes a second horizontal boom angle $\theta_{B2}$ to which boom 602 is to be horizontally rotated (in a clockwise direction) and a third horizontal platform angle $\theta_{P3}$ to which platform 604 is to be horizontally rotated (in a counterclockwise direction) based on the offset angle $\theta_O$ and the extension distance. The control unit then generates control signals to cause boom 602 to horizontally rotate to the second horizontal boom angle $\theta_{B2}$ and platform 604 to horizontally rotate to the third horizontal platform angle $\theta_{P3}$. Accordingly, in some embodiments, boom 602 and platform 604 are caused to rotate in opposite horizontal directions, i.e., clockwise and counterclockwise directions.

In some examples, the control unit may attempt to align implement 610 with guidance line 630 using only horizontal platform angle $\theta_P$ (such as at time T1) and, if it is not possible to align implement 610 with guidance line 630 using only horizontal platform angle $\theta_P$, the control unit may use both horizontal platform angle $\theta_P$ and horizontal boom angle $\theta_B$ (such as at times T2 and T3). In other examples, the control unit may attempt to align implement 610 with guidance line 630 using only horizontal boom angle $\theta_B$ and, if it is not possible to align implement 610 with guidance line 630 using only horizontal boom angle $\theta_B$, the control unit may use both horizontal platform angle $\theta_P$ and horizontal boom angle $\theta_B$.

Figure 7:
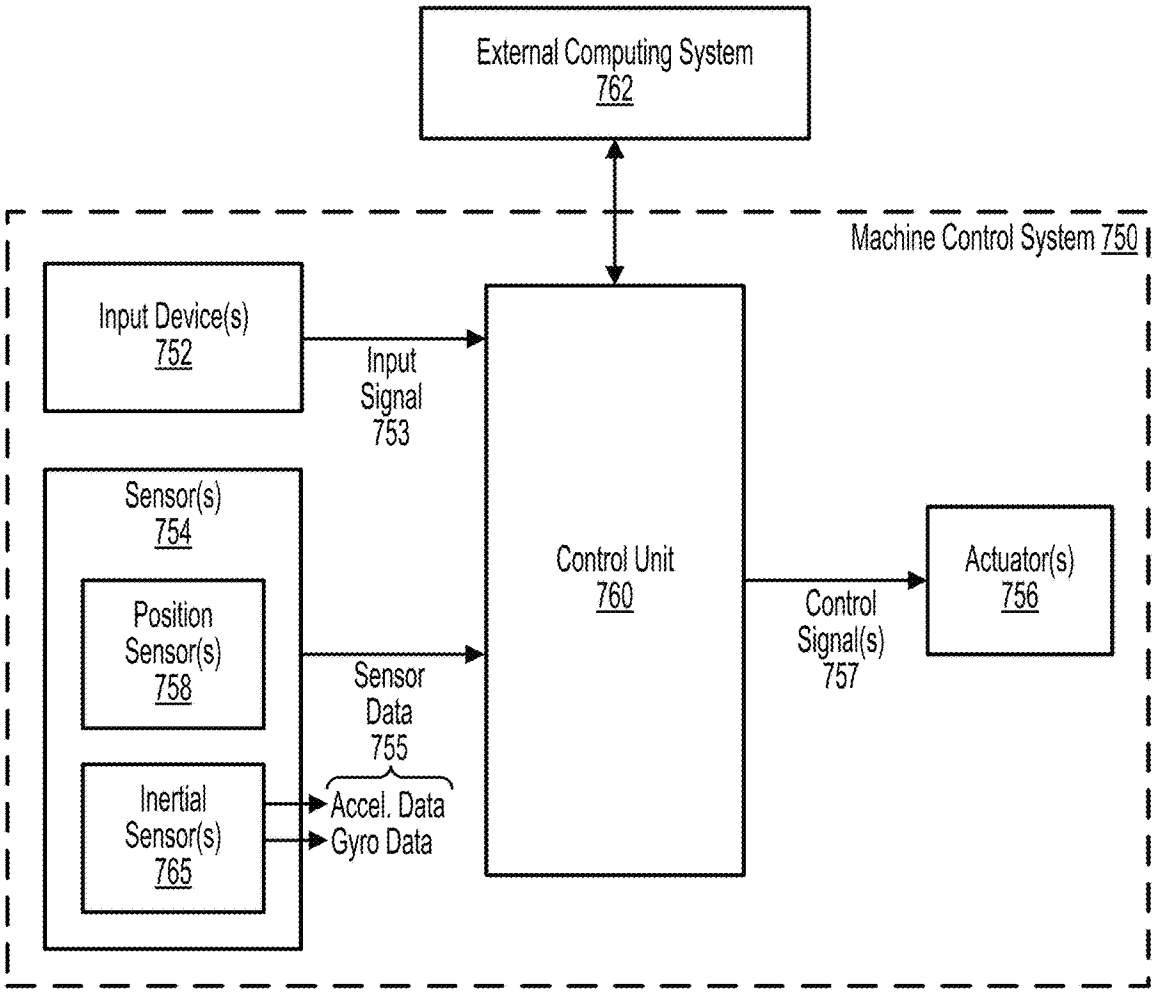
FIG. 7 illustrates an example machine control system.

FIG. 7 illustrates an example machine control system 750, in accordance with some embodiments of the present disclosure. Machine control system 750 may include various input devices 752, sensors 754, actuators 756, and computing devices for allowing one or more operators of the construction machine to complete a work-related task. The components of machine control system 750 may be mounted to or integrated with the components of the construction machine such that the construction machine may include machine control system 750. The components of machine control system 750 may be communicatively coupled to each other via one or more wired and/or wireless connections.

Machine control system 750 may include a control unit 760 that receives data from the various sensors and inputs and generates commands that are sent to the various actuators and output devices. In the illustrated example, control unit 760 receives an input signal 753 from input device(s) 752 and sensor data 755 from sensor(s) 754, and generates control signal(s) 757 which are sent to actuator(s) 756. Control unit 760 may include one or more processors and an associated memory. In some embodiments, control unit 760 may be communicatively coupled to an external computing system 762 located external to machine control system 750 and the construction machine. External computing system 762 may send instructions to control unit 760 of the details of a work-related task. External computing system 762 may also send alerts and other general information to control unit 760, such as traffic conditions, weather conditions, the locations and status of material transfer vehicles, and the like.

An operator can use input device(s) 752 to produce input signal 753 that indicates a desired movement of the vehicle, a desired movement of the implement, a desired extension distance of the implement, a desired height of the implement, an activation of one or more mechanisms on the implement (e.g., sprayers, cutters, etc.), and the like. Input device(s) 752 can include a keyboard, a touchscreen, a touchpad, a switch, a lever, a button, a steering wheel, an acceleration pedal, a brake pedal, and the like. Input device(s) 752 can be mounted to any physical part of the vehicle, such as within the cab of the vehicle, or may include one or more wearable or handheld devices.

Sensor(s) 754 can include one or more position sensor(s) 758 and/or inertial sensor(s) 765. Position sensor(s) 758 can be a combination of GNSS receivers, which determine position using wireless signals received from satellites, and total stations, which determine position by combining distance, vertical angle, and horizontal angle measurements. Inertial sensor(s) 765 can include one or more sensors that detect movement of the components of the construction machine to which they are rigidly attached. For example, inertial sensor(s) 765 can include one or more gyroscopes for detecting angular acceleration, angular rate and/or angular position, one or more accelerometers for detecting linear acceleration, linear velocity, and/or linear position, one or more inertial measurement units (IMUs) which may each include one or more accelerometers, one or more gyroscopes, and/or one or more magnetometers for detecting the above-listed types of data, among other possibilities.

Inertial sensor(s) 765 can directly detect angular rate and integrate to obtain angular position, or alternatively, an inertial sensor can directly measure angular position and determine a change in angular position (e.g., compute the derivative) to obtain angular rate. In many instances, inertial sensor(s) 765 can be used to determine the yaw angle (rotation angle with respect to a vertical axis), the pitch angle (rotation angle with respect to a transverse axis), and/or the roll angle (rotation angle with respect to a longitudinal axis) of the construction machine.

Control unit 760 may include various controllers and modules to assist in the generation of control signal(s) 757. Each of the controllers and modules may include dedicated hardware and/or may be performed using the main processor and/or memory of control unit 760. Control signal(s) 757 may include direct current (DC) or alternating current (AC) voltage signals, DC or AC current signals, and/or information-containing signals. An example of an information-containing signal may be controller area network (CAN) message that may be sent along a CAN bus or other communication medium. In some instances, control signal(s) 757 include a pneumatic or hydraulic pressure. Upon receiving control signal(s) 757, actuator(s) 756 may be caused to move in a specified manner, such as by extending, retracting, rotating, lifting, or lowering by a specified amount. Actuator(s) 756 may use various forms of power to provide movement to the components of the construction machine. For example, actuator(s) 756 may be electric, hydraulic, pneumatic, mechanical, or thermal, among other possibilities. Actuator(s) 756 may include a boom cylinder, a stick cylinder, an implement cylinder, a boom swing cylinder, among other possibilities.

Figure 8:
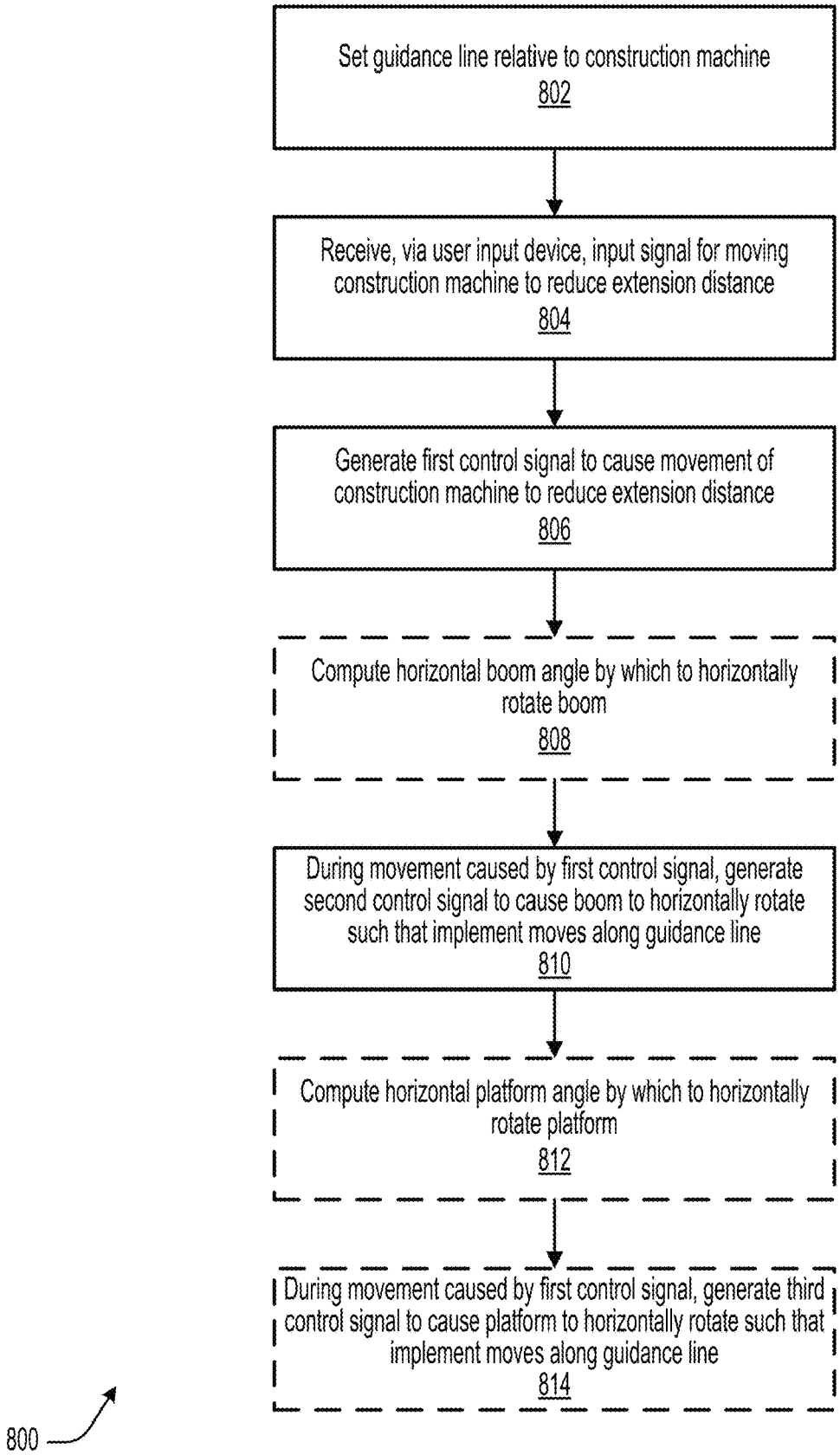
FIG. 8 illustrates an example method of controlling a construction machine.

FIG. 8 illustrates a method 800 of controlling a construction machine, in accordance with some embodiments of the present disclosure. Steps of method 800 may be performed in any order and/or in parallel, and one or more steps of method 800 may be optionally performed. One or more steps of method 800 may be performed by one or more processors, such as those included in a control unit. Method 800 may be implemented as a computer-readable medium or computer program product comprising instructions which, when the program is executed by one or more processors, cause the one or more processors to carry out the steps of method 800.

At step 802, a control unit (e.g., control units 160, 760) sets a guidance line (e.g., guidance lines 330, 430, 530, 630) for guiding an implement (e.g., implements 110, 210, 310, 410, 510, 610) of a construction machine (e.g., construction machines 100, 200, 300, 400, 500, 600). The construction machine may further include a boom (e.g., booms 102, 202, 302, 402, 502, 602), a platform (e.g., platforms 104, 204, 304, 404, 504, 604), and an undercarriage (e.g., undercarriages 106, 206, 306, 406, 506, 606). The guidance line may have a linear or non-linear path relative to the position and orientation of the construction machine. The guidance line may be defined by two or more 2D or 3D positions (e.g., a first position defining one end of the guidance line and a second position defining the opposite end of the guidance line, or a plurality of positions defining points along the guidance line, etc.). The positions of the guidance line may be determined based on a site plan. For example, the site plan may indicate that a ditch needs to be created between two positions. The control unit may set the guidance line after the construction machine has positioned itself near where the guidance line is to be set or the construction machine may navigate to the position of the guidance line.

At step 804, the control unit receives, via a user input device (e.g., input device 752), an input signal (e.g., input signal 753) for moving the construction machine to reduce an extension distance (e.g., extension distance $d_E$). The extension distance may be calculated as the distance between the platform of the construction machine and the implement. The input signal may be generated by an operator of the construction machine pulling a lever that brings the implement closer to the platform by raising the boom and decreasing the angle between the boom and a stick (e.g., sticks 108, 208, 308, 408, 508, 608) of the construction machine. In some examples, the extension distance may be calculated as the distance between an axis of rotation (e.g., axis of rotations 126, 226, 326, 426, 526, 626) of the boom with respect to the platform and the implement. More accurately, in some examples, the extension distance may be calculated from the implement's edge, such as the bucket's teeth of an excavator.

At step 806, the control unit generates a first control signal (e.g., control signal 757) to cause a movement of the construction machine to reduce the extension distance. For example, the first control signal may be generated in response to the control unit receiving the input signal. The first control signal may be sent to actuators (e.g., actuators 756) of the construction machine that control the raising the of boom (such as boom cylinder 114) and the decreasing of the angle between the boom and the stick (such as stick cylinder 116).

At step 808, optionally, the control unit computes a horizontal boom angle (e.g., horizontal boom angle $\theta_B$) to which to horizontally rotate the boom with respect to the platform. In some examples, the horizontal boom angle may be computed based on the extension distance. In some examples, the horizontal boom angle may be computed further based on an offset angle (e.g., offset angle $\theta_O$) between an orientation of the construction machine and the guidance line. In some examples, step 808 may be repeatedly performed to update the horizontal boom angle as the extension distance decreases during the movement caused by the first control signal.

At step 810, during the movement of the construction machine caused by the first control signal, the control unit generates a second control signal (e.g., control signal 757) to cause the boom to horizontally rotate with respect to the platform to the horizontal boom angle. In some examples, the second control signal may be repeatedly updated as the horizontal boom angle is repeatedly updated. The movement of the construction machine caused by the second control signal, in combination with the movement of the construction machine caused by the first control signal, causes the implement to move along the guidance line and remain aligned with the guidance line while the boom horizontally rotates. In some examples, a guidance point (e.g., guidance point 332) may be set to a particular point on the implement. In such examples, the horizontal boom angle may be computed such that the guidance point moves along the guidance line and remains aligned with the guidance line while the boom horizontally rotates.

At step 812, optionally, the control unit computes a horizontal platform angle (e.g., horizontal platform angle $\theta_P$) to which to horizontally rotate the platform with respect to the undercarriage. In some examples, the horizontal platform angle may be computed based on the extension distance. In some examples, the horizontal platform angle may be computed further based on the offset angle between the orientation of the construction machine and the guidance line. In some examples, step 812 may be repeatedly performed to update the horizontal platform angle as the extension distance decreases during the movement caused by the first control signal.

At step 814, optionally, during the movement of the construction machine caused by the first control signal, the control unit generates a third control signal (e.g., control signal 757) to cause the platform to horizontally rotate with respect to the undercarriage to the horizontal platform angle. In some examples, the third control signal may be repeatedly updated as the horizontal platform angle is repeatedly updated. The movement of the construction machine caused by the third control signal, in combination with the movement of the construction machine caused by the first control signal and the movement of the construction machine caused by the second control signal, causes the implement to move along the guidance line and remain aligned with the guidance line while the boom horizontally rotates. In some examples, the horizontal platform angle may be computed such that the guidance point moves along the guidance line and remains aligned with the guidance line while the platform horizontally rotates.

Figure 9:
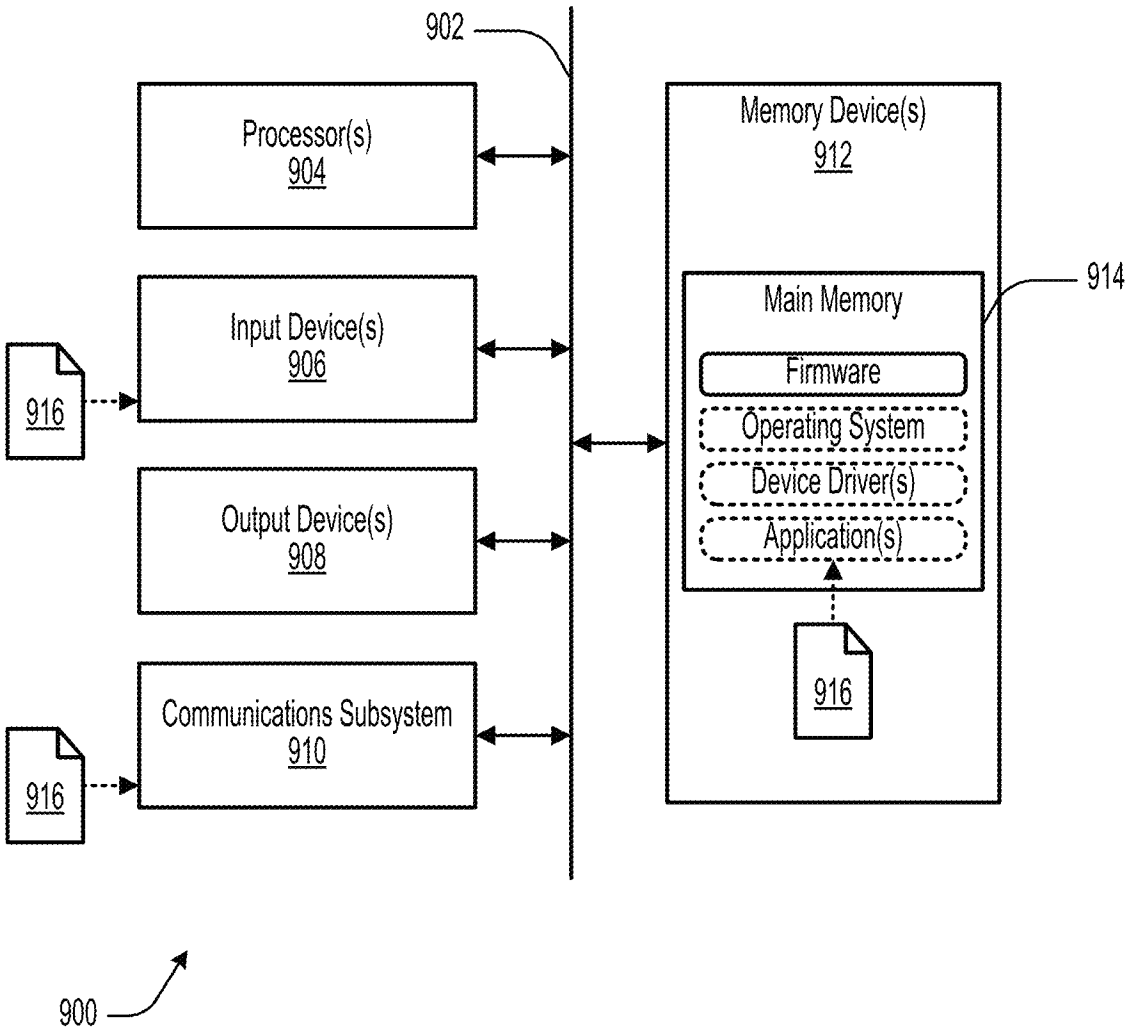
FIG. 9 illustrates an example computer system comprising various hardware elements.

FIG. 9 illustrates an example computer system 900 comprising various hardware elements, in accordance with some embodiments of the present disclosure. Computer system 900 may be incorporated into or integrated with devices described herein and/or may be configured to perform some or all of the steps of the methods provided by various embodiments. For example, in various embodiments, computer system 900 may be incorporated into machine control system 750 and/or may be configured to perform method 800. It should be noted that FIG. 9 is meant only to provide a generalized illustration of various components, any or all of which may be utilized as appropriate. FIG. 9, therefore, broadly illustrates how individual system elements may be implemented in a relatively separated or relatively more integrated manner.

In the illustrated example, computer system 900 includes a communication medium 902, one or more processor(s) 904, one or more input device(s) 906, one or more output device(s) 908, a communications subsystem 910, and one or more memory device(s) 912. Computer system 900 may be implemented using various hardware implementations and embedded system technologies. For example, one or more elements of computer system 900 may be implemented within an integrated circuit (IC), an application-specific integrated circuit (ASIC), an application-specific standard product (ASSP), a field-programmable gate array (FPGA), such as those commercially available by XILINX®, INTEL®, or LATTICE SEMICONDUCTOR®, a system-on-a-chip (SoC), a microcontroller, a printed circuit board (PCB), and/or a hybrid device, such as an SoC FPGA, among other possibilities.

The various hardware elements of computer system 900 may be communicatively coupled via communication medium 902. While communication medium 902 is illustrated as a single connection for purposes of clarity, it should be understood that communication medium 902 may include various numbers and types of communication media for transferring data between hardware elements. For example, communication medium 902 may include one or more wires (e.g., conductive traces, paths, or leads on a PCB or integrated circuit (IC), microstrips, striplines, coaxial cables), one or more optical waveguides (e.g., optical fibers, strip waveguides), and/or one or more wireless connections or links (e.g., infrared wireless communication, radio communication, microwave wireless communication), among other possibilities.

In some embodiments, communication medium 902 may include one or more buses that connect the pins of the hardware elements of computer system 900. For example, communication medium 902 may include a bus that connects processor(s) 904 with main memory 914, referred to as a system bus, and a bus that connects main memory 914 with input device(s) 906 or output device(s) 908, referred to as an expansion bus. The system bus may itself consist of several buses, including an address bus, a data bus, and a control bus. The address bus may carry a memory address from processor(s) 904 to the address bus circuitry associated with main memory 914 in order for the data bus to access and carry the data contained at the memory address back to processor(s) 904. The control bus may carry commands from processor(s) 904 and return status signals from main memory 914. Each bus may include multiple wires for carrying multiple bits of information and each bus may support serial or parallel transmission of data.

Processor(s) 904 may include one or more central processing units (CPUs), graphics processing units (GPUs), neural network processors or accelerators, digital signal processors (DSPs), and/or other general-purpose or special-purpose processors capable of executing instructions. A CPU may take the form of a microprocessor, which may be fabricated on a single IC chip of metal-oxide-semiconductor field-effect transistor (MOSFET) construction. Processor(s) 904 may include one or more multi-core processors, in which each core may read and execute program instructions concurrently with the other cores, increasing speed for programs that support multithreading.

Input device(s) 906 may include one or more of various user input devices such as a mouse, a keyboard, a microphone, as well as various sensor input devices, such as an image capture device, a temperature sensor (e.g., thermometer, thermocouple, thermistor), a pressure sensor (e.g., barometer, tactile sensor), a movement sensor (e.g., accelerometer, gyroscope, tilt sensor), a light sensor (e.g., photodiode, photodetector, charge-coupled device), and/or the like. Input device(s) 906 may also include devices for reading and/or receiving removable storage devices or other removable media. Such removable media may include optical discs (e.g., Blu-ray discs, DVDs, CDs), memory cards (e.g., CompactFlash card, Secure Digital (SD) card, Memory Stick), floppy disks, Universal Serial Bus (USB) flash drives, external hard disk drives (HDDs) or solid-state drives (SSDs), and/or the like.

Output device(s) 908 may include one or more of various devices that convert information into human-readable form, such as without limitation a display device, a speaker, a printer, a haptic or tactile device, and/or the like. Output device(s) 908 may also include devices for writing to removable storage devices or other removable media, such as those described in reference to input device(s) 906. Output device(s) 908 may also include various actuators for causing physical movement of one or more components. Such actuators may be hydraulic, pneumatic, electric, and may be controlled using control signals generated by computer system 900.

Communications subsystem 910 may include hardware components for connecting computer system 900 to systems or devices that are located external to computer system 900, such as over a computer network. In various embodiments, communications subsystem 910 may include a wired communication device coupled to one or more input/output ports (e.g., a universal asynchronous receiver-transmitter (UART)), an optical communication device (e.g., an optical modem), an infrared communication device, a radio communication device (e.g., a wireless network interface controller, a BLUETOOTH® device, an IEEE 802.11 device, a Wi-Fi device, a Wi-Max device, a cellular device), among other possibilities.

Memory device(s) 912 may include the various data storage devices of computer system 900. For example, memory device(s) 912 may include various types of computer memory with various response times and capacities, from faster response times and lower capacity memory, such as processor registers and caches (e.g., L0, L1, L2), to medium response time and medium capacity memory, such as random-access memory (RAM), to lower response times and lower capacity memory, such as solid-state drives and hard drive disks. While processor(s) 904 and memory device(s) 912 are illustrated as being separate elements, it should be understood that processor(s) 904 may include varying levels of on-processor memory, such as processor registers and caches that may be utilized by a single processor or shared between multiple processors.

Memory device(s) 912 may include main memory 914, which may be directly accessible by processor(s) 904 via the address and data buses of communication medium 902. For example, processor(s) 904 may continuously read and execute instructions stored in main memory 914. As such, various software elements may be loaded into main memory 914 to be read and executed by processor(s) 904 as illustrated in FIG. 9. Typically, main memory 914 is volatile memory, which loses all data when power is turned off and accordingly needs power to preserve stored data. Main memory 914 may further include a small portion of non-volatile memory containing software (e.g., firmware, such as BIOS) that is used for reading other software stored in memory device(s) 912 into main memory 914. In some embodiments, the volatile memory of main memory 914 is implemented as RAM, such as dynamic random-access memory (DRAM), and the non-volatile memory of main memory 914 is implemented as read-only memory (ROM), such as flash memory, erasable programmable read-only memory (EPROM), or electrically erasable programmable read-only memory (EEPROM).

Computer system 900 may include software elements, shown as being currently located within main memory 914, which may include an operating system, device driver(s), firmware, compilers, and/or other code, such as one or more application programs, which may include computer programs provided by various embodiments of the present disclosure. Merely by way of example, one or more steps described with respect to any methods discussed above, may be implemented as instructions 916, which are executable by computer system 900. In one example, such instructions 916 may be received by computer system 900 using communications subsystem 910 (e.g., via a wireless or wired signal that carries instructions 916), carried by communication medium 902 to memory device(s) 912, stored within memory device(s) 912, read into main memory 914, and executed by processor(s) 904 to perform one or more steps of the described methods. In another example, instructions 916 may be received by computer system 900 using input device(s) 906 (e.g., via a reader for removable media), carried by communication medium 902 to memory device(s) 912, stored within memory device(s) 912, read into main memory 914, and executed by processor(s) 904 to perform one or more steps of the described methods.

In some embodiments of the present disclosure, instructions 916 are stored on a computer-readable storage medium (or simply computer-readable medium). Such a computer-readable medium may be non-transitory and may therefore be referred to as a non-transitory computer-readable medium. In some cases, the non-transitory computer-readable medium may be incorporated within computer system 900. For example, the non-transitory computer-readable medium may be one of memory device(s) 912 (as shown in FIG. 9). In some cases, the non-transitory computer-readable medium may be separate from computer system 900. In one example, the non-transitory computer-readable medium may be a removable medium provided to input device(s) 906 (as shown in FIG. 9), such as those described in reference to input device(s) 906, with instructions 916 being read into computer system 900 by input device(s) 906. In another example, the non-transitory computer-readable medium may be a component of a remote electronic device, such as a mobile phone, that may wirelessly transmit a data signal that carries instructions 916 to computer system 900 and that is received by communications subsystem 910 (as shown in FIG. 9).

Instructions 916 may take any suitable form to be read and/or executed by computer system 900. For example, instructions 916 may be source code (written in a human-readable programming language such as Java, C, C++, C#, Python), object code, assembly language, machine code, microcode, executable code, and/or the like. In one example, instructions 916 are provided to computer system 900 in the form of source code, and a compiler is used to translate instructions 916 from source code to machine code, which may then be read into main memory 914 for execution by processor(s) 904. As another example, instructions 916 are provided to computer system 900 in the form of an executable file with machine code that may immediately be read into main memory 914 for execution by processor(s) 904. In various examples, instructions 916 may be provided to computer system 900 in encrypted or unencrypted form, compressed or uncompressed form, as an installation package or an initialization for a broader software deployment, among other possibilities.

In one aspect of the present disclosure, a system (e.g., computer system 900) is provided to perform methods in accordance with various embodiments of the present disclosure. For example, some embodiments may include a system comprising one or more processors (e.g., processor(s) 904) that are communicatively coupled to a non-transitory computer-readable medium (e.g., memory device(s) 912 or main memory 914). The non-transitory computer-readable medium may have instructions (e.g., instructions 916) stored therein that, when executed by the one or more processors, cause the one or more processors to perform the methods described in the various embodiments.

In another aspect of the present disclosure, a computer-program product that includes instructions (e.g., instructions 916) is provided to perform methods in accordance with various embodiments of the present disclosure. The computer-program product may be tangibly embodied in a non-transitory computer-readable medium (e.g., memory device(s) 912 or main memory 914). The instructions may be configured to cause one or more processors (e.g., processor(s) 904) to perform the methods described in the various embodiments.

In another aspect of the present disclosure, a non-transitory computer-readable medium (e.g., memory device(s) 912 or main memory 914) is provided. The non-transitory computer-readable medium may have instructions (e.g., instructions 916) stored therein that, when executed by one or more processors (e.g., processor(s) 904), cause the one or more processors to perform the methods described in the various embodiments.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of exemplary configurations including implementations. However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of the technology. Also, a number of steps may be undertaken before, during, or after the above elements are considered. Accordingly, the above description does not bind the scope of the claims.

As used herein and in the appended claims, the singular forms "a", "an", and "the" include plural references unless the context clearly dictates otherwise. Thus, for example, reference to "a user" includes reference to one or more of such users, and reference to "a processor" includes reference to one or more processors and equivalents thereof known to those skilled in the art, and so forth.

Also, the words "comprise," "comprising," "contains," "containing," "include," "including," and "includes," when used in this specification and in the following claims, are intended to specify the presence of stated features, integers, components, or steps, but they do not preclude the presence or addition of one or more other features, integers, components, steps, acts, or groups.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A computer-implemented method comprising:

setting a guidance line for guiding an implement of a construction machine, the guidance line having a path relative to a position of the construction machine, the construction machine having a boom, a platform, and an undercarriage, wherein the boom is connected to the platform at a boom swing joint, the boom being horizontally rotatable with respect to the platform, and wherein the platform is connected to the undercarriage;

receiving, via a user input device, an input signal for manually moving the construction machine to reduce an extension distance between the implement and the platform;

generating a first control signal to cause a movement of the construction machine to reduce the extension distance in response to the input signal; and concurrently with the movement of the construction machine to reduce the extension distance, automatically and repeatedly:

monitoring a changing value of the extension distance resulting from the movement caused by the first control signal; and generating a second control signal based at least in part on the changing value of the extension distance to cause the boom to horizontally rotate with respect to the platform such that the implement moves along and remains aligned with the guidance line.

2. The method of claim 1, wherein the second control signal causes a boom swing cylinder to extend or retract to cause the boom to horizontally rotate.

3. The method of claim 1, further comprising:

computing a horizontal boom angle to which to horizontally rotate the boom based at least on the extension distance, wherein the second control signal causes the boom to horizontally rotate with respect to the platform to the horizontal boom angle.

4. The method of claim 3, wherein the horizontal boom angle is determined further based on an offset angle between an orientation of the construction machine and the guidance line.

5. The method of claim 1, further comprising:

during the movement of the construction machine, generating a third control signal to cause the platform to horizontally rotate with respect to the undercarriage such that the implement moves along and remains aligned with the guidance line.

6. The method of claim 5, further comprising:

computing a horizontal platform angle to which to horizontally rotate the platform based at least on the extension distance, wherein the third control signal causes the platform to horizontally rotate with respect to the undercarriage to the horizontal platform angle.

7. The method of claim 6, wherein the horizontal platform angle is determined further based on an offset angle between an orientation of the construction machine and the guidance line.

8. The method of claim 1, wherein the construction machine is an excavator, and wherein the implement is a bucket.

9. A non-transitory computer-readable medium comprising instructions that, when executed by one or more processors, cause the one or more processors to perform operations comprising:

setting a guidance line for guiding an implement of a construction machine, the guidance line having a path relative to a position of the construction machine, the construction machine having a boom, a platform, and an undercarriage, wherein the boom is connected to the platform at a boom swing joint, the boom being horizontally rotatable with respect to the platform, and wherein the platform is connected to the undercarriage;

receiving, via a user input device, an input signal for manually moving the construction machine to reduce an extension distance between the implement and the platform;

generating a first control signal to cause a movement of the construction machine to reduce the extension distance in response to the input signal; and concurrently with the movement of the construction machine to reduce the extension distance, automatically and repeatedly:

monitoring a changing value of the extension distance resulting from the movement caused by the first control signal; and generating a second control signal based at least in part on the changing value of the extension distance to cause the boom to horizontally rotate with respect to the platform such that the implement moves along and remains aligned with the guidance line.

10. The non-transitory computer-readable medium of claim 9, wherein the second control signal causes a boom swing cylinder to extend or retract to cause the boom to horizontally rotate.

11. The non-transitory computer-readable medium of claim 9, wherein the operations further comprise:

computing a horizontal boom angle to which to horizontally rotate the boom based at least on the extension distance, wherein the second control signal causes the boom to horizontally rotate with respect to the platform to the horizontal boom angle.

12. The non-transitory computer-readable medium of claim 11, wherein the horizontal boom angle is determined further based on an offset angle between an orientation of the construction machine and the guidance line.

13. The non-transitory computer-readable medium of claim 9, wherein the operations further comprise:

during the movement of the construction machine, generating a third control signal to cause the platform to horizontally rotate with respect to the undercarriage such that the implement moves along and remains aligned with the guidance line.

14. The non-transitory computer-readable medium of claim 13, wherein the operations further comprise:

computing a horizontal platform angle to which to horizontally rotate the platform based at least on the extension distance, wherein the third control signal causes the platform to horizontally rotate with respect to the undercarriage to the horizontal platform angle.

15. The non-transitory computer-readable medium of claim 14, wherein the horizontal platform angle is determined further based on an offset angle between an orientation of the construction machine and the guidance line.

16. The non-transitory computer-readable medium of claim 9, wherein the construction machine is an excavator, and wherein the implement is a bucket.

17. A machine control system for controlling a construction machine, the machine control system comprising:

one or more processors; and a computer-readable medium comprising instructions that, when executed by the one or more processors, cause the one or more processors to perform operations comprising:

setting a guidance line for guiding an implement of a construction machine, the guidance line having a path relative to a position of the construction machine, the construction machine having a boom, a platform, and an undercarriage, wherein the boom is connected to the platform at a boom swing joint, the boom being horizontally rotatable with respect to the platform, and wherein the platform is connected to the undercarriage;

receiving, via a user input device, an input signal for manually moving the construction machine to reduce an extension distance between the implement and the platform;

generating a first control signal to cause a movement of the construction machine to reduce the extension distance in response to the input signal; and concurrently with the movement of the construction machine to reduce the extension distance, automatically and repeatedly:

monitoring a changing value of the extension distance resulting from the movement caused by the first control signal; and generating a second control signal based at least in part on the changing value of the extension distance to cause the boom to horizontally rotate with respect to the platform such that the implement moves along and remains aligned with the guidance line.

18. The machine control system of claim 17, wherein the second control signal causes a boom swing cylinder to extend or retract to cause the boom to horizontally rotate.

19. The machine control system of claim 17, wherein the operations further comprise:

computing a horizontal boom angle to which to horizontally rotate the boom based at least on the extension distance, wherein the second control signal causes the boom to horizontally rotate with respect to the platform to the horizontal boom angle.

20. The machine control system of claim 19, wherein the horizontal boom angle is determined further based on an offset angle between an orientation of the construction machine and the guidance line.

* * * * *